US010052747B2

(12) United States Patent
Aoki

(10) Patent No.: US 10,052,747 B2
(45) Date of Patent: Aug. 21, 2018

(54) HAMMER TOOL

(71) Applicant: MAKITA CORPORATON, Anjo-shi, Aichi (JP)

(72) Inventor: Yonosuke Aoki, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 613 days.

(21) Appl. No.: 14/425,186

(22) PCT Filed: Aug. 30, 2013

(86) PCT No.: PCT/JP2013/073355
§ 371 (c)(1),
(2) Date: Mar. 2, 2015

(87) PCT Pub. No.: WO2014/034862
PCT Pub. Date: Mar. 6, 2014

(65) Prior Publication Data

US 2015/0246438 A1 Sep. 3, 2015

(30) Foreign Application Priority Data

Sep. 3, 2012 (JP) ..... 2012-193582
Sep. 3, 2012 (JP) ..... 2012-193583

(51) Int. Cl.
*B25D 11/00* (2006.01)
*B25D 11/12* (2006.01)

(52) U.S. Cl.
CPC ..... *B25D 11/005* (2013.01); *B25D 11/125* (2013.01); *B25D 2211/003* (2013.01);
(Continued)

(58) Field of Classification Search
CPC ..... B25D 17/24; B25D 11/12; B25D 9/26; B25D 11/005; B25D 11/125;
(Continued)

(56) References Cited

U.S. PATENT DOCUMENTS 1,901,981 A * 3/1933 Ousback ..... B25D 11/062 173/115
1,959,516 A * 5/1934 Baker ..... B25D 11/12 173/115
(Continued)

FOREIGN PATENT DOCUMENTS

EP 1607186 * 12/2005
JP S56-98531 A 8/1981
(Continued)

OTHER PUBLICATIONS

Oct. 8, 2013 International Search Report issued in International Patent Application No. PCT/JP2013/073355.
(Continued)

*Primary Examiner* — Nathaniel Chukwurah
*Assistant Examiner* — Eduardo R Ferrero
(74) *Attorney, Agent, or Firm* — Oliff PLC

(57) ABSTRACT

A hammer tool for hammering on a workpiece by a tool bit moving at least linearly in a longitudinal direction of the tool bit, configured so that a hammering element moves toward the tool bit to hits the tool bit by way of air pressure fluctuation in an air chamber when a driving element is moved from a first position to a second position. In addition, the stroke center position of the reciprocating movement of the driving element moved between the first position and the second position is configured to be changeable.

21 Claims, 11 Drawing Sheets

(52) U.S. Cl.
CPC .. *B25D 2250/021* (2013.01); *B25D 2250/245* (2013.01); *B25D 2250/275* (2013.01)

(58) Field of Classification Search
CPC ..... B25D 2211/003; B25D 2250/245; B25D 2250/021
See application file for complete search history.

(56) References Cited

U.S. PATENT DOCUMENTS 2,873,611 A * 2/1959 Biermann ..... F02B 75/045 123/48 B
3,305,031 A * 2/1967 Bez ..... B25D 11/005 173/115
3,507,337 A * 4/1970 Chromy ..... B25D 16/006 173/115
4,031,763 A * 6/1977 Eisenberg ..... B23D 51/16 30/392
4,487,272 A * 12/1984 Bleicher ..... B25D 11/005 173/109
5,036,925 A * 8/1991 Wache ..... B25D 11/005 173/104
5,337,835 A * 8/1994 Bohne ..... B25D 11/005 173/109
6,209,659 B1 * 4/2001 Blessing ..... B25D 9/04 173/109
6,687,567 B2 * 2/2004 Watanabe ..... B25B 23/1405 173/11
6,913,088 B2 * 7/2005 Berger ..... B25D 11/005 173/201
7,419,013 B2 * 9/2008 Sainomoto ..... B25B 23/1405 173/104
7,926,584 B2 * 4/2011 John ..... B25D 11/005 173/1
8,267,189 B2 * 9/2012 Manschitz ..... B25D 11/125 173/104
8,272,452 B2 * 9/2012 Katou ..... B25D 11/005 173/176
2002/0056558 A1 5/2002 Bongers-Ambrosius et al.
2004/0194986 A1 * 10/2004 Ikuta ..... B25D 11/005 173/48
2004/0200628 A1 * 10/2004 Schmitzer ..... B25D 16/006 173/1
2004/0226728 A1 * 11/2004 Boeni ..... B25D 11/005 173/2
2006/0048958 A1 * 3/2006 Ikuta ..... B25D 11/005 173/201
2006/0076154 A1 4/2006 Aoki
2007/0125563 A1 * 6/2007 Furusawa ..... B25D 16/006 173/48
2009/0020299 A1 1/2009 Manschitz et al.
2009/0020302 A1 * 1/2009 Fuenfer ..... B25D 11/005 173/204
2009/0032275 A1 * 2/2009 Ikuta ..... B25D 17/24 173/117
2010/0038105 A1 * 2/2010 Kikuchi ..... B25D 17/24 173/162.2
2010/0163262 A1 * 7/2010 Ookubo ..... B25D 17/24 173/162.2
2015/0246438 A1 * 9/2015 Aoki ..... B25D 11/125 173/2

FOREIGN PATENT DOCUMENTS

JP H07-150969 A 6/1995
JP 2002079476 A 3/2002
JP 2004299036 A 10/2004
JP 2007175836 A 7/2007
JP 2009023084 A 2/2009
JP 2011183482 A 9/2011
JP 5467514 B2 * 4/2014

OTHER PUBLICATIONS

Dec. 22, 2015 Office Action issued in Japanese Patent Application No. 2012-193583.
Dec. 22, 2015 Office Action issued in Japanese Patent Application No. 2012-193582.
Oct. 8, 2013 Written Opinion issued in International Patent Application No. PCT/JP2013/073355.
Mar. 3, 2015 International Preliminary Report on Patentability issued in International Patent Application No. PCT/JP2013/073355.

* cited by examiner

HAMMER TOOL

FIELD OF THE INVENTION

The present invention relates to an hammer tool which drives a tool bit and performs a hammering operation on a workpiece, in which the tool bit moves linearly in a longitudinal direction of the tool bit.

BACKGROUND OF THE INVENTION

A hammer tool disclosed in Japanese Unexamined Patent Application Publication No. 2002-79476, drives a striker via an air pressure fluctuation within an air chamber or an air spring effect caused by relative movement between a piston as a driving element and the striker as a hammering element, and the driven striker moves forward and hits a hammer bit.

In the hammer tool described above, when a hammering operation while pushing a tip of the hammer bit against a workpiece, a stroke amount of the piston is varied in accordance with pushing force that a user applies to a grip of the hammer tool. Thereby, the hammer tool controls impact force during the hammering operation.

SUMMARY OF THE INVENTION

Problem to be Solved by the Invention

In the hammer tool which drives the striker via the air spring effect, after the striker hits the hammer bit, the striker moves toward the piston by reaction force (hereinafter called as hammering reaction force) caused by the hitting and vacuum force caused within the air chamber when the piston returns to a position before the striker hits the hammer bit. The inventor found that a return speed of the striker or a return amount of the striker is not always constant due to differences of hammering operation aspects, for example a kind of a workpiece, especially hardness of a workpiece. That is, the inventor found that as the hardness of a workpiece is harder, hammering reaction force applied on the striker becomes larger, as the hardness of a workpiece is softer, hammering reaction force becomes smaller, and further the return speed of the striker and the return amount of the striker are varied by the hammering reaction force. As described above, when the return speed or the return amount of the striker varies, a distance between the striker and the piston varies, and impact energy transmitted from the striker to the hammer bit varies.

The object of the present invention is, in consideration with the above-described problem, to provide an improved hammer tool which is capable of performing a rational hammering operation.

Means for Solving the Problem

The above-described problem is solved by the invention according to claim 1. According to a preferable aspect of a hammer tool according to the present invention, the hammer tool which drives a tool bit at least linearly in a longitudinal direction of the tool bit and performs a hammering operation on a workpiece is constructed. The hammer tool comprises a main body, a cylinder which is arranged in the main body and extended in the longitudinal direction of the tool bit, a hammering element which drives linearly in the longitudinal direction of the tool bit in the cylinder and hits the tool bit, a driving element which is slidably arranged in the cylinder and is configured to moves the hammering element, and a driving apparatus which drives the driving element. The driving element is arranged inside the cylinder such that it is reciprocally movable between a first position which is remote from the tool bit and a second position which is close to the tool bit. When the driving element is moved from the first position to the second position, the driving element moves the hammering element toward the tool bit and the hammering element hits the tool bit. Further, a stroke center position of a reciprocating movement of the driving element which is reciprocally moved between the first position and the second position is configured to be changeable.

Further, a stroke length is a distance between the first position and the second position. The stroke center position is positioned at the same distance from the first position and the second position between the first position and the second position. Further, the first position and the second position are moved due to a movement of the stroke center position. The stroke center position may be changed by moving a part of a driving apparatus for driving the driving element, or by moving whole of the driving apparatus.

According to the present invention, since the stroke center position of the reciprocating movement of the driving element which is moved between the first position and the second position is changeable, a hammer tool which is capable of performing a rationalized hammer operation according to an operation aspect is provided. For example, in the hammer tool which is constructed to drive the hammering element via an air spring effect of an air chamber, the characteristic of the air spring is varied by changing the distance between the driving element and the hammering element based on the hardness of a workpiece. Specifically, if a workpiece is harder, the stroke center position of the driving element is moved to be remote from the tool bit, and if a workpiece is softer, the stroke center position of the driving element is moved to be close to the tool bit. Thereby, by controlling the characteristic of the air spring, variation in impact energy based on the hardness of a workpiece is suppressed. As a result, the hammering operation is appropriately performed.

Further, for example, when the hammering operation is started, in order to move actively the resting hammering element, the stroke center position of the driving element is moved to be close to the tool bit. On the other hand, after starting the hammering operation, the stroke center position of the driving element may be moved to be remote from the tool bit.

According to a further aspect of the hammer tool according to the present invention, the hammer tool comprises a switch apparatus for changing the stroke center position. Further, change of the stroke center position by the switch apparatus may be performed in a stepping manner or in a stepless manner.

According to this aspect, the stroke center position of the reciprocating movement of the driving element is changed by the switch apparatus.

According to a further aspect of the hammer tool according to the present invention, the switch apparatus is configured to be manually operable by a user.

According to this aspect, as the switch apparatus is manually operable by a user, a user can change the stroke center position of the reciprocating movement of the driving element according to an operation aspect.

According to a further aspect of the hammer tool according to the present invention, the hammer tool comprises a control apparatus which controls the switch apparatus. Further, the control apparatus is configured to change the stroke center position by controlling the switch apparatus.

According to this aspect, as the control apparatus controls the switch apparatus and thereby changes the stroke center position, the stroke center position is automatically changed.

According to a further aspect of the hammer tool according to the present invention, the hammer tool comprises a first sensor which measures reaction force caused by the hammering operation of the tool bit. Further, the control apparatus is configured to control the switch apparatus based on a measured result of the first sensor and change the stroke center position.

According to this aspect, the control apparatus controls the switch apparatus based on the reaction force caused by the hammering operation of the tool bit. Accordingly, the stroke center position of the reciprocating movement of the driving element is automatically changed based on a reaction force level of the reaction force.

According to a further aspect of the hammer tool according to the present invention, the hammer tool comprises a second sensor which measures a position of the tool bit. Further, the control apparatus is configured to control the switch apparatus based on a measured result of the second sensor and change the stroke center position. Further, the second sensor may directly detect the position of the tool bit or detect the position of the tool bit by detecting the position of the hammering element.

According to this aspect, the control apparatus controls the switch apparatus based on the position of the tool bit. Accordingly, the stroke center position of the reciprocating movement of the driving element is automatically changed based on the position of the tool bit.

According to a further aspect of the hammer tool according to the present invention, the hammer tool comprises a third sensor which measures vibration caused on the main body. Further, the control apparatus is configured to control the switch apparatus based on a measured result of the third sensor and change the stroke center position.

According to this aspect, the control apparatus controls the switch apparatus based on a vibration level of the vibration caused on the main body. Accordingly, the stroke center position of the reciprocating movement of the driving element is automatically changed based on the vibration caused on the main body.

According to a further aspect of the hammer tool according to the present invention, the hammer tool comprises a fourth sensor which measures a parameter applied on the driving apparatus, the parameter indicating a load state of the hammer tool. Further, the control apparatus is configured to control the switch apparatus based on a measured result of the fourth sensor and change the stroke center position.

Further, the parameter indicates the load state of the hammer tool corresponds to, for example, current of a motor or a heat generation of the motor.

According to this aspect, the control apparatus controls the switch apparatus based on the load state of the hammer tool. Accordingly, the stroke center position of the reciprocating movement of the driving element is automatically changed based on the load state of the hammer tool.

According to a further aspect of the hammer tool according to the present invention, the driving apparatus comprises a motor and a crank mechanism which is rotationally driven by the motor. The crank mechanism comprises a crank shaft which has an eccentric shaft, the crank shaft rotationally driven by the motor, and a swing member which is connected to the eccentric shaft swingably around the eccentric shaft. The hammer tool further comprises a connecting member which connects the swing member and the driving element, one end side of the connecting member is swingably connected to the swing member and the other end side is swingably connected to the driving element, and a control member one end side of which is swingably connected to the swing member and the other end side of which is swingably connected to a support part arranged on the main body. Further, the stroke center position is changed by changing a position of the support part. Further, the position of the support part may be configured to be automatically changed or manually changeable by a user.

According to this aspect, the stroke center position is changed by changing the position of the support part of the control apparatus.

According to a further aspect of the hammer tool according to the present invention, the hammer tool comprises a switch apparatus for changing the stroke center position, a control apparatus which controls the switch apparatus, and a fifth sensor which measures load applied on the support part. Further, the control apparatus is configured to control the switch apparatus based on a measurement result of the fifth sensor and change the stroke center position.

According to this aspect, a position of the support part is automatically changed based on the load applied on the support part.

According to a further aspect of the hammer tool according to the present invention, a stroke length of the driving element is changed when the stroke center position is changed.

According to this aspect, the stroke length of the driving element is changed due to a position change of the driving element. In such a case, it is preferable that when the stroke center position is moved to be close to the tool bit, the stroke length becomes shorter, and when the stroke center position is moved to be remote from the tool bit, the stroke length becomes longer. Thus, the hammer tool is appropriately driven according to operation aspects.

According to a further aspect of the hammer tool according to the present invention, the hammer tool comprises a connection rod which is connected to the driving element, and a crank mechanism which is connected to the connection rod and drives the driving element. While the driving element is moved from a bottom dead center which is the most remote from the tool bit to a top dead center which is the closest to the tool bit, a straight line passing a connecting part of the connection rod and the driving element and a connecting part of the connection rod and the crank mechanism is arranged to be parallel to the cylinder. Further, the driving element typically corresponds to a piston which slides within the cylinder.

At the bottom dead center which corresponds to 0 degree crank angle and the top dead center which corresponds to 180 degrees crank angle, the velocity of the driving element in a moving direction of the driving element becomes equal to zero. That is, to drive the hammering element toward the tool bit while the driving element is moved from the bottom dead center to the top dead center is reasonable. For example, in an air driving type hammer tool, as the hammering element is slidable, air inside the cylinder maximally compressed while the driving element is moved from the bottom dead center to the top dead center is preferable. According to the aspect, while the driving element is moved from the bottom dead center to the top dead center, the connection rod is arranged to be parallel to the cylinder. Accordingly, in a maximally compressed status, force in a direction crossing the moving direction of the driving element is prevented from applying on the driving element.

Thus, friction loss between the driving element and the cylinder is reduced. As a result, the driving element is efficiently driven.

According to a further aspect of the hammer tool according to the present invention, with respect to a crank angle of the crank mechanism, the bottom dead center corresponds to 0 degree crank angle and the top dead center corresponds to 180 degrees crank angle. Further, when the driving element is located at substantially 90 degrees crank angle position during a rotation from the bottom dead center to the top dead center, the connection rod becomes parallel to the cylinder.

In the hammer tool in which the driving element is driven by the crank mechanism, velocity of the driving element toward the tool bit becomes maximum speed in substantially 90 degrees crank angle position of the crank mechanism. For example, in the hammer tool in which the tool bit is hit by utilizing an air spring, when the driving element is located at substantially 90 degrees angle position on the way to the top dead center from the bottom dead center, an air chamber which serves the air spring is defined to be maximally compressed. Accordingly, it is preferable that at the substantially 90 degrees crank angle position, the connection rod becomes parallel to the cylinder. Further, in this aspect, the substantially 90 degrees means a range between 70 degrees through 110 degrees.

Further, according to a further aspect of the hammer tool according to the present invention, when the connection rod is parallel to the cylinder, the hammering element is configured to start to move toward the tool bit. According to this aspect, force applied on the driving element in a direction crossing the moving direction of the driving element is reduced. Thus, friction loss between the driving element and the cylinder is reduced. As a result, kinetic energy of the driving element is efficiently transmitted to the hammering element.

Further, according to a further aspect of the hammer tool according to the present invention, a rotation center of the crank mechanism is arranged to be offset from a reciprocating moving line of the driving element moved inside the cylinder with respect to a direction crossing the reciprocating moving line.

According to this aspect, the rotation center of the crank mechanism is offset from the reciprocating moving line of the driving element in the direction crossing the reciprocating moving line. Accordingly, by adjusting an offset amount, the connection rod is easily set to be parallel to the cylinder while the driving element is moved from the bottom dead center to the top dead center.

Further, according to a further aspect of the hammer tool according to the present invention, the crank mechanism comprises a rotatable crank shaft and an eccentric shaft connected to the crankshaft at a position eccentric from a rotational axis of the crank shaft. Further, the hammer tool further comprises a swing member which is interveningly arranged between the eccentric shaft and the connection rod and swingably connected to both of the eccentric shaft and the connection rod respectively, and a control member one end side of which is swingably supported on the main body and the other end side of which is swingably connected to the swing member.

According to this aspect, as the swing member is arranged between the eccentric shaft and the connection rod, when the eccentric shaft is rotated, a connecting part of the swing member which is connected to the connection rod performs an orbital motion along substantially ellipse track. The longitudinal axis of the ellipse extends along the moving direction of the driving element. Thus, a moving amount of the connecting part in the moving direction of the driving element is larger than a moving amount of the eccentric shaft in the moving direction of the driving element. That is, with respect to the moving direction of the driving element, the moving amount of the eccentric shaft is amplified and transmitted to the driving element. Therefore, a moving amount of the eccentric shaft in a direction crossing the moving direction of the driving element is much smaller than the moving amount of the driving element. Accordingly, swing angle of the connection rod becomes smaller and thereby interference of the connection rod against the cylinder is prevented. Further, axial length of the connection rod may be shortened. As a result, the driving apparatus is able to be arranged close to the cylinder. Thus, downsizing of the hammer tool is achieved.

Further, according to a further aspect of the hammer tool according to the present invention, the hammer tool comprises a first support part which connects the swing member and the connection rod in a swingable manner to each other, and a second support part which connects the swing member and the control member in a swingable manner to each other. Further, the eccentric shaft is arranged between the first support part and the second support part in an extending direction of a line passing the first support part and the second support part.

According to this aspect, each component of the crank mechanism is rationally arranged.

Accordingly, an improved hammer tool which is capable of performing a rational hammer operation is provided.

Other objects, features and advantages of the present invention will be readily understood after reading the following detailed description together with the accompanying drawings and the claims.

DESCRIPTION OF THE PREFERRED EMBODIMENTS

Each of the additional features and method steps disclosed above and below may be utilized separately or in conjunction with other features and method steps to provide and manufacture improved hammer tools and method for using such hammer tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment

Figure 1:
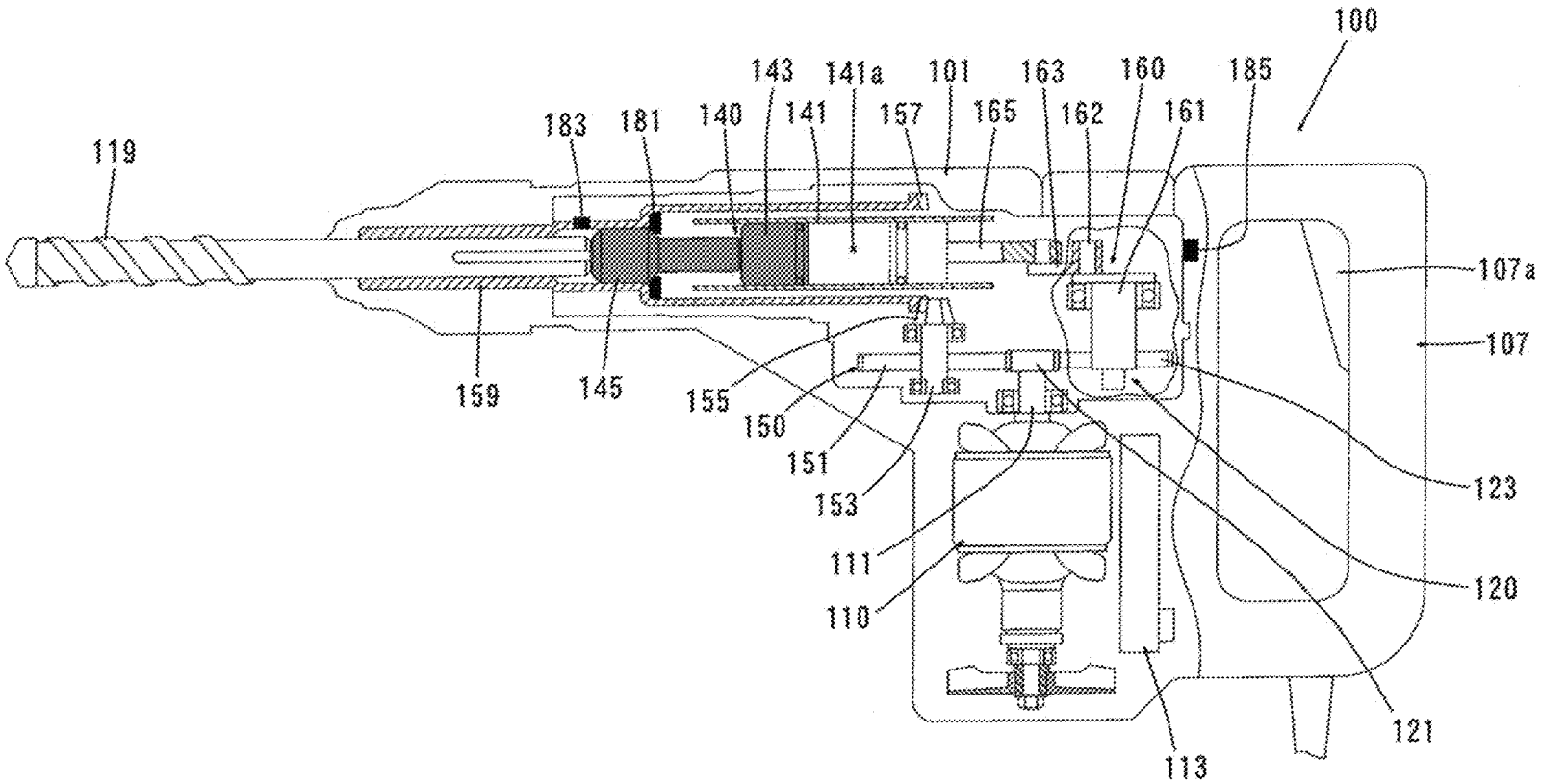
FIG. 1 shows a cross sectional view of whole construction of a hammer drill according to a first embodiment.

A first embodiment is explained as below with reference to FIG. 1 to FIG. 12. In the first embodiment, an electric hammer drill as one example of the hammer tool is used for the explanation. As shown in FIG. 1, a hammer drill 100 is an hammer tool to which a hammer bit 119 is attached and drives the attached hammer bit 119 linearly in a longitudinal direction and around the longitudinal direction of the hammer bit 119 and thereby performs a operation such as a drilling or a chipping on a workpiece. The hammer bit 119 is an example of a feature which corresponds to "a tool bit" of the present invention.

As shown in FIG. 1, the hammer drill 100 is mainly provided with a main housing 101 which forms an outline of the hammer drill 100. The hammer bit 119 is detachably attached to a front end region of the main housing 101 via a cylindrical tool holder 159. The hammer bit 119 is attached to the tool holder 159 such that it is relatively movable against the tool holder 159 in its longitudinal direction and rotates integrally with the tool holder 159. The main housing 101 is an example of a feature which corresponds to "a main body" of the present invention.

A hand grip 107 held by a user is connected to an opposite end region which is opposite to the front end region. The hand grip 107 is provided as a substantially D-shaped main handle in a side view, in which it is extended in a vertical direction of FIG. 1 which crosses the longitudinal direction of the hammer bit 119, and each ends of its extending direction are connected to the main housing 101.

In the first embodiment, for convenience of explanation, the hammer bit 119 side of the main housing 101 in a longitudinal direction of the main housing 101 is defined as a front side or a forward side, the hand grip 107 side of the main housing 101 is defined as a rear side or a rearward side.

As shown in FIG. 1, the main housing 101 houses an electric motor 110, a motion converting mechanism 120, a hammering element 140 and a motion transmitting mechanism 150. The electric moto 110 is arranged such that an output shaft 111 is inconformity with a vertical direction which is substantially perpendicular to the longitudinal direction of the main housing 101 (longitudinal direction of the hammer bit 119). Torque of the electric motor 110 is converted as needed into a linear motion by the motion converting mechanism 120 and thereafter transmitted to the hammering element 140, and causes impact force in the longitudinal direction of the hammer bit 119 (lateral direction of FIG. 1) via the hammering element 140. The electric motor 110 is an example of a feature which corresponds to "a motor" of the present invention.

Moreover, torque of the electric motor 110 is transmitted to the hammer bit 119 via the tool holder 159 after its rotation speed is decelerated by the motion transmitting mechanism. 150, and then the hammer bit 119 is rotationally driven in its circumference direction. The tool holder 159 is housed within the main housing 101 and holds the hammer bit 119 at the front end region (left hand side of FIG. 1) of the main housing 101. Further, the tool holder 159 is extended in the longitudinal direction of the hammer bit 119, and supported in a rotatable manner around its longitudinal direction against the main housing 101. Further, the electric motor 110 is turned on and driven by a pulling operation of a trigger 107*a* arranged on the hand grip 107.

As shown in FIG. 1, the motion converting mechanism 120 is mainly provided with a link type crank mechanism 160, and linearly reciprocates a piston 131. The crank mechanism 160 is driven via a driving gear 121 which is formed on the motor shaft 111 and a driven gear 123 which is meshed and engaged with the driving gear 121. The piston 131 is provided as a driving member which drives the hammering element 140. The piston 131 is linearly reciprocated within a cylinder 141 in a direction same as the longitudinal direction of the hammer bit 119. The cylinder 141 is provided as a cylindrical member. The cylinder 141 is arranged coaxially with the tool holder 159 rearward of the tool holder 159, and supported in a fixed manner against the main housing 101. The piston 131 is an example of a feature which corresponds to "a driving element" of the present invention.

As shown in FIG. 1, the hammering element 140 is mainly provided with a striker 143 and an impact bolt 145. The striker 143 is slidably arranged within the cylinder 141. The impact bolt 145 is slidably arranged within the tool holder 159 and is served as an intermediate element which transmits a kinetic energy of the striker 143 to the hammer bit 119. An inner wall of the cylinder 141, the piston 131 and striker 143 form an air chamber 141*a*. The striker 143 is driven via an air spring effect, that is an air pressure fluctuation inside the air chamber 141*a*, caused by a sliding motion of the piston 131 from rear side (right side of FIG. 1) to front side (left side of FIG. 1). The striker 143 moves frontward and collides with the impact bolt 145, and causes hammering force on the hammer bit 119 via impact bolt 145. The striker 143 is an example of a feature which corresponds to "a hammering element" of the present invention.

As shown in FIG. 1, the motion converting mechanism 150 is mainly provided with an intermediate gear 151, an intermediate shaft 153, a small bevel gear 155 and a large bevel gear 157. The intermediate bevel gear 151 is fixed on the intermediate shaft 153 and the intermediate bevel gear 151 meshes and engages with the driving gear 121. The small bevel gear 155 is arranged on the intermediate shaft 153 and engaged with the large bevel gear 155. The large bevel gear 155 is rotated with the tool holder 159. Thus, the motion transmitting mechanism 150 transmits torque of the electric motor 110 to the hammer bit 119 held by the tool holder 159. Further, the intermediate shaft 153 is arranged parallel to the motor shaft 111 of the electric motor 110 and perpendicular to the longitudinal direction of the hammer bit 119.

Next, the link type crank mechanism 160 for linearly reciprocating the piston 131 is explained with reference to FIG. 1 to FIG. 3. The link type crank mechanism 160 is mainly provided with a crank shaft 161, a link 163 and a control lever 167, and the link type crank mechanism 160 is arranged rearward of the cylinder 141 (rearward of the piston 131). The link type crank mechanism 160 and the piston 131 are connected by the connection rod 165. The link type crank mechanism 160 is an example of a feature which corresponds to "a driving apparatus" of the present invention. Further, the crank shaft 161 is an example of a feature which corresponds to "a crank shaft", and the link 163 is an example of a feature which corresponds to "a swing member", and the connection rod 165 is an example of a feature which corresponds to "a control member" of the present invention.

The crank shaft 161 is rotatably supported by the main housing 101 and rotated by the driven bear 123. The crank shaft 161 has a crank pin 162 which is arranged at a position offset from the rotation center of the crank shaft 161 in a predetermined distance in a radial direction of the crank shaft 161. Further, the crank shaft 161 is arranged such that its rotation axis is offset from a moving center axis of the piston 131 in a predetermined distance in a direction crossing the moving center axis of the piston 131. One end of the connection rod 165 in its axial direction is connected in a relatively rotatable manner to the piston 131 via a piston pin 164. The crank pin 162 is an example of a feature which corresponds to "an eccentric shaft" of the present invention.

The link 163 is arranged so as to extend perpendicular to a longitudinal direction of the piston 131. Further, an intermediate region in the extending direction of the link 163 is connected in a relative rotatable (swingable) manner to the crankpin 162 of the crankshaft 161. Further, one end of the link 163 in its extending direction is rotatably connected to the other end of the connection rod 165 in its axial direction via the link pin 166.

The control lever 167 is arranged so as to extend in the front-rear direction. One end of the control lever 167 is connected in a relatively rotatable manner to other end of the link 163 in its extending direction via a connection pin 168. Further, the other end of the control lever 167 is connected in a swingable manner to the main housing 101. Accordingly, the control lever 167 swings and thereby controls movement of the link 163. In other words, the control lever 167 is provided as a regulation member which regulates the degree of freedom of movement of the link 163 such that the link type crank mechanism 160 performs a predetermined operation.

In the hammer drill 100 constructed above, when the electric motor 110 is tuned on and driven, the piston 131 is linearly moved within the cylinder 141 via the link type crank mechanism 160. Accordingly, air pressure in the air chamber 141*a* is fluctuated, and thereby the striker 143 is moved forward by the air spring effect. As a result, the impact bolt 145 hits the hammer bit 119. On the other hand, the motion transmitting mechanism 150 rotates the tool holder 159 together with the hammer bit 119 around the longitudinal direction of the hammer bit 119. Thus, the hammer bit 119 performs a hammering operation in its axial direction and a drilling operation around the axial direction, and thereby operation on a workpiece such as concrete and so on is performed.

Figure 4:
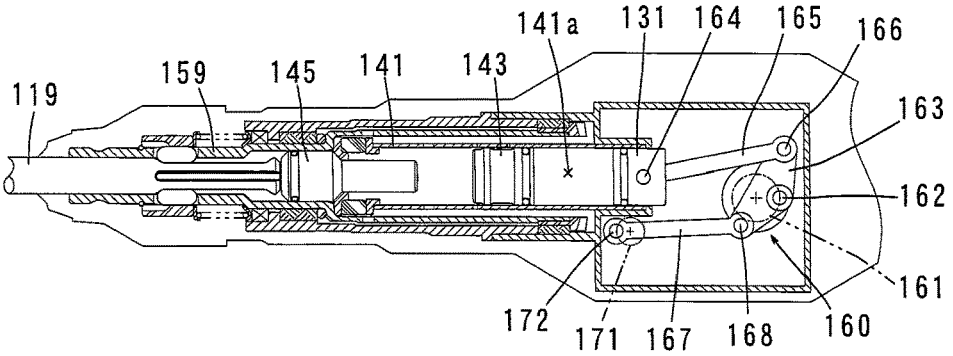
FIG. 4 shows a cross sectional view of operating link type crank mechanism in which the stroke center position of the piston is moved rearward and shows the bottom dead center in which the piston is moved to the most rear position (0 degree crank angle position).
Figure 5:
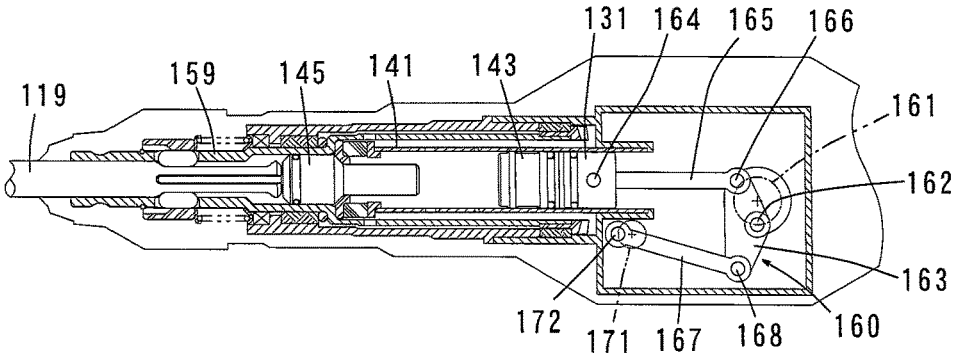
FIG. 5 shows a cross sectional view in which the piston is moved (to substantially 90 degrees crank angle position) from the bottom dead center shown in FIG. 4 toward the top dead center and shows air chamber maximally compressed state.
Figure 6:
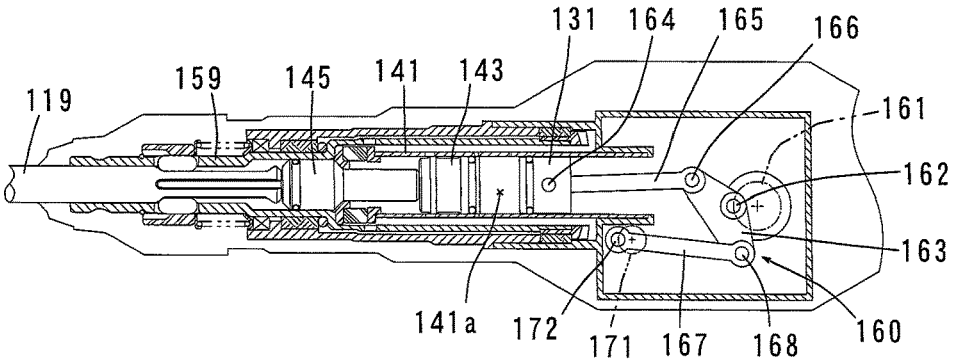
FIG. 6 shows a cross sectional view of the top dead center in which the piston is moved to the most front position (180 degrees crank angle position).
Figure 7:
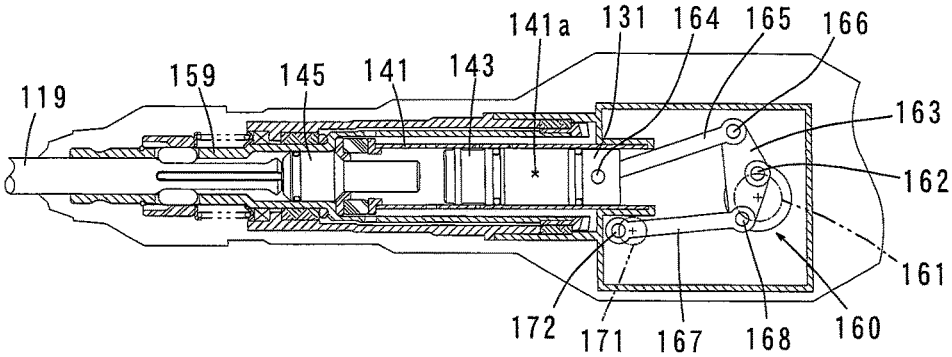
FIG. 7 shows a cross sectional view in which the piston is moved (to substantially 270 degrees crank angle position) from the top dead center toward the bottom dead center.
Figure 8:
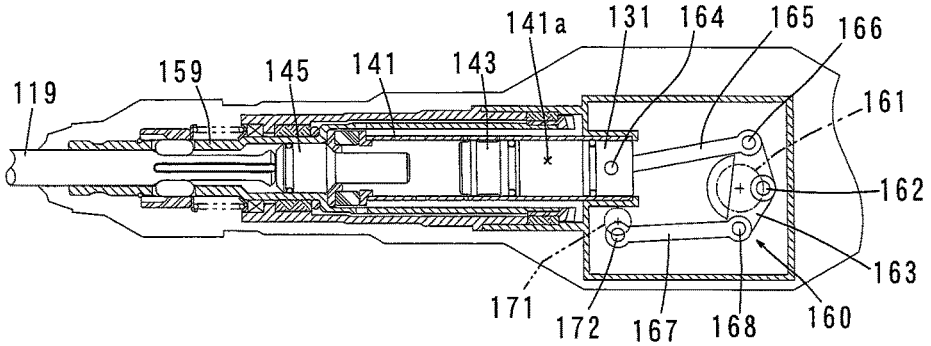
FIG. 8 shows a cross sectional view of operating link type crank mechanism in which the stroke center position of the piston is moved frontward and shows the bottom dead center in which the piston is moved to the most rear position (0 degree crank angle position).
Figure 9:
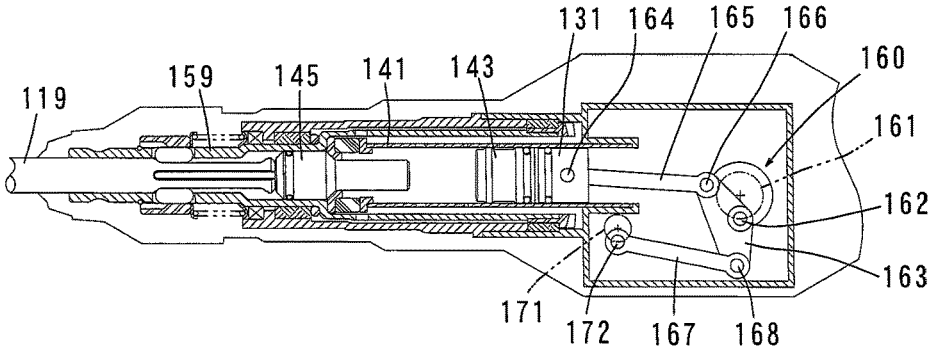
FIG. 9 shows a cross sectional view in which the piston is moved (to substantially 90 degrees crank angle position) from the bottom dead center shown in FIG. 8 toward the top dead center and shows air chamber maximally compressed state.
Figure 10:
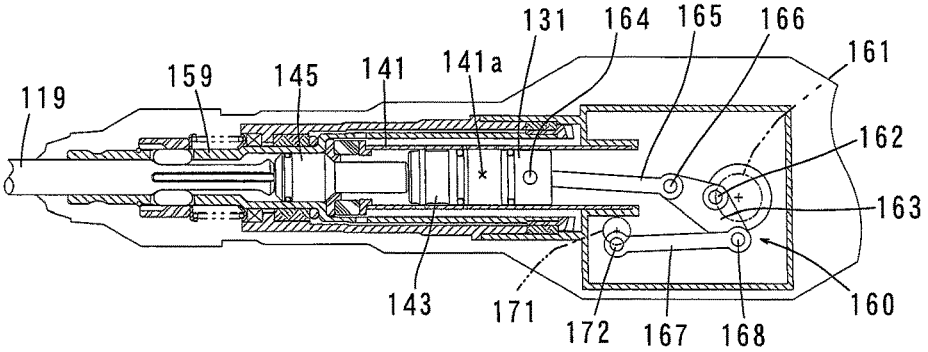
FIG. 10 shows a cross sectional view of the top dead center in which the piston is moved to the most front position (180 degrees crank angle position).

FIG. 4 to FIG. 11 illustrate movement of the piston 131, that is, FIG. 4 and FIG. 8 illustrate a status of the piston 131 in which it is moved and positioned in the most rear position (hereinafter called as bottom dead center) which is 0 degree (360 degrees) crank angle position with respect to position of the crank pin 162. FIG. 6 and FIG. 10 illustrate a status of the piston 131 in which it is moved and positioned in the most front position (hereinafter called as top dead center) which is 180 degrees crank angle position with respect to position of the crank pin 162. The bottom dead center is an example of a feature which corresponds to "a first position", and the top dead center is an example of a feature which corresponds to "a second position" of the present invention.

Figure 11:
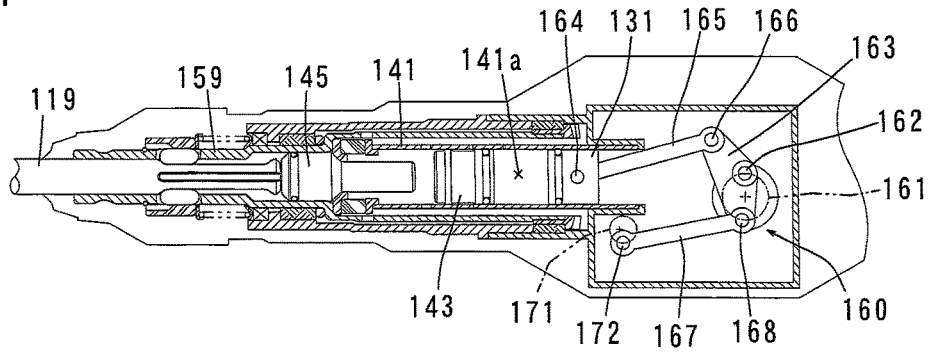
FIG. 11 shows a cross sectional view in which the piston is moved (to substantially 270 degrees crank angle position) from the top dead center toward the bottom dead center.

The piston 131 is reciprocated between the top dead center and the bottom dead center. When, the piston 131 is moved forward from the bottom dead center to the top dead center, the striker 143 is moved forward via the air spring effect of the air chamber 141*a* and hits the hammer bit 119 via the impact bolt 145. As shown in FIG. 7 and FIG. 11, after hammering operation, the striker 143 is returned rearward by the hammering reaction force and negative pressure which is caused by declaration in air pressure of the air chamber 141*a* when the piston 131 is moved from the top dead center to the bottom top center.

In the hammer drill 100 which drives the striker 143 via the air spring effect of the air chamber 141*a*, maximum air compression state of the air chamber 141*a* is defined by positions of the piston 131 and the striker 143. As shown in FIG. 5 and FIG. 9, after the hammering operation, the striker 143 is moved rearward by the hammering reaction and the negative pressure to be close to the piston 131 which is moved forward for the next hammering operation, and thereby the air chamber 141*a* becomes the maximum air compression state. The position of the piston 131 corresponding to the maximum air compression state is generally defined as substantially 90 degrees (within the range between 70 to 110 degrees) crank angle position proceeded from the bottom dead center toward the top dead center.

The inventor found that the hammering reaction force applied to the striker 143 is changed based on a kind of a workpiece, especially hardness of the workpiece. Further, a return speed or a return amount of the striker 143 is changed by such a fluctuation of the reaction force. As a result, distance between the piston 131 and the striker 143 is changed. That is, when workpiece is hard, distance between the piston 133 and the striker 143 becomes short, and when workpiece is soft, distance between the piston 133 and the striker 143 becomes long. Accordingly, the inventor found that impact energy transmitted to the hammer bit 119 is changed based on change of the distance between the piston 133 and the striker 143.

Taking the above description into consideration, in order to suppress the fluctuation of the impact energy, the hammer drill 100 controls the distance between the piston 131 and the striker 143 by changing the center position of a stroke of reciprocal movement of the piston 131 based on hardness of a workpiece. Thus, as shown in FIG. 2 and FIG. 3, the other end of the control lever 167 is swingably supported with respect to the main housing 101. That is, the control lever 167 is attached to an eccentric shaft 172 of a control shaft 171. The control shaft 171 is rotatably attached to the main housing 101. The control shaft 171 is arranged parallel to the crank shaft 161. Accordingly, when the control shaft 171 is rotated, the eccentric shaft 172 as a swinging fulcrum of the control lever 167 is rotated around a center axis of the control shaft 171. Solid lines in FIG. 2 and FIG. 3 illustrate a state in which the eccentric shaft 172 is moved and positioned forward by rotation of the control shaft 171. Further, dashed lines in FIG. 2 and FIG. 3 illustrate a state in which the eccentric shaft 172 is moved and positioned rearward by rotation of the control shaft 171. The eccentric shaft 172 is an example of a feature which corresponds to "a support part" of the present invention.

Figure 2:
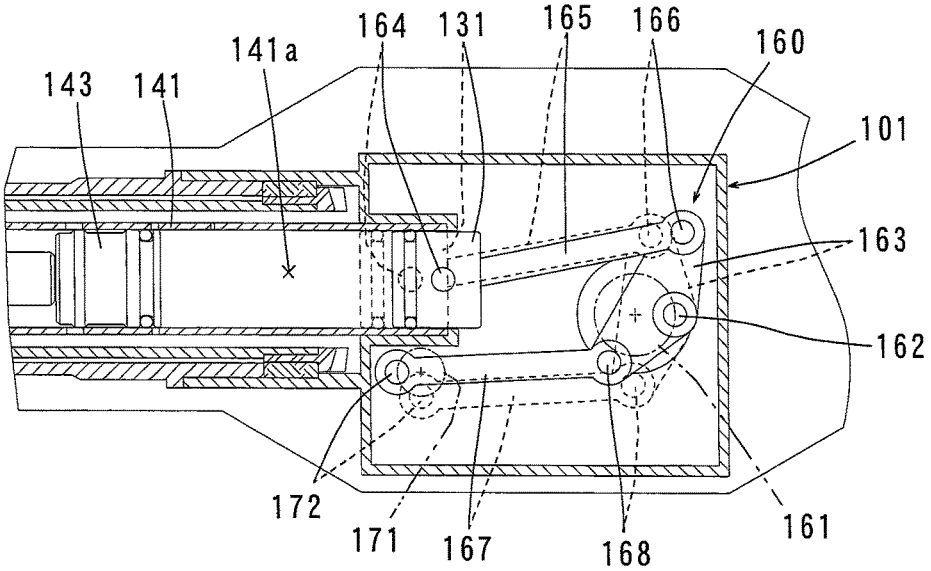
FIG. 2 shows a view for comparing between piston positions at a bottom dead center of the piston in which a state that a stroke center position is moved rearward (remote side from a hammer bit) is illustrated by straight lines, and a state that the stroke center position is moved forward (close side to the hammer bit) is illustrated by broken lines.
Figure 3:
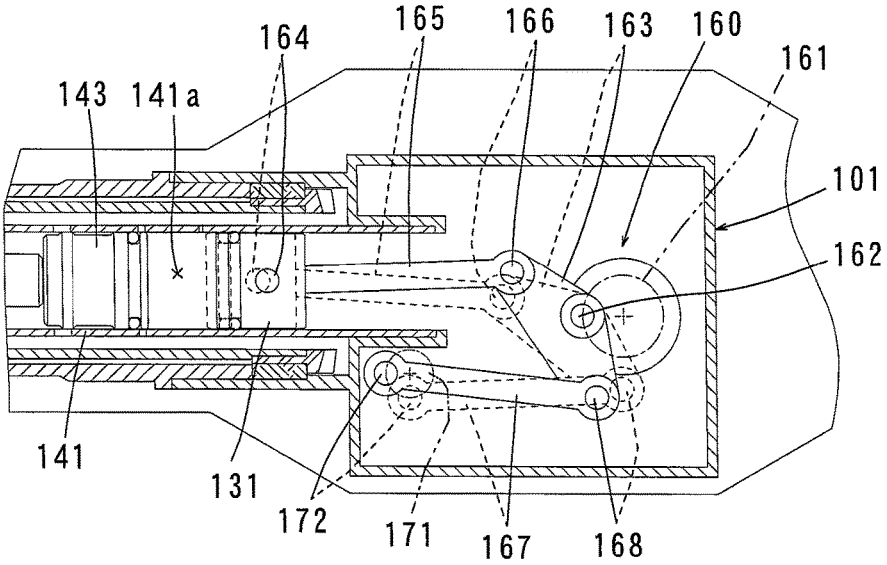
FIG. 3 shows a view for comparing between piston positions at a top dead center of the piston in which a state that a stroke center position is moved rearward is illustrated by straight lines, and a state that the stroke center position is moved forward is illustrated by broken lines.

As shown in FIG. 2 and FIG. 3, when the position of the eccentric shaft 172 of the control shaft 171 is changed, the link 163 is moved forward or rearward via the control lever 167 with the crank pin 162 as the fulcrum. Thus, the piston 131 is moved forward or rearward via the connection rod 165. As a result, stroke center position of the piston 131 is moved front-rear direction (moving direction of the piston 131). That is, when the eccentric shaft 172 is moved forward, the stroke center position of the piston 131 is moved rearward, and when the eccentric shaft 172 is moved rearward, the stroke center position of the piston 131 is moved forward. Accordingly, the control shaft 171 having the eccentric shaft 172 as the swinging fulcrum of the control lever 167 is served as a stroke center position changing mechanism which changes the stroke center position of the piston 131. Further, continuous lines and broken lines in each FIG. 2 and FIG. 3 illustrate the control shaft 171 are rotated in approximately 90 degrees to each other.

Figure 12:
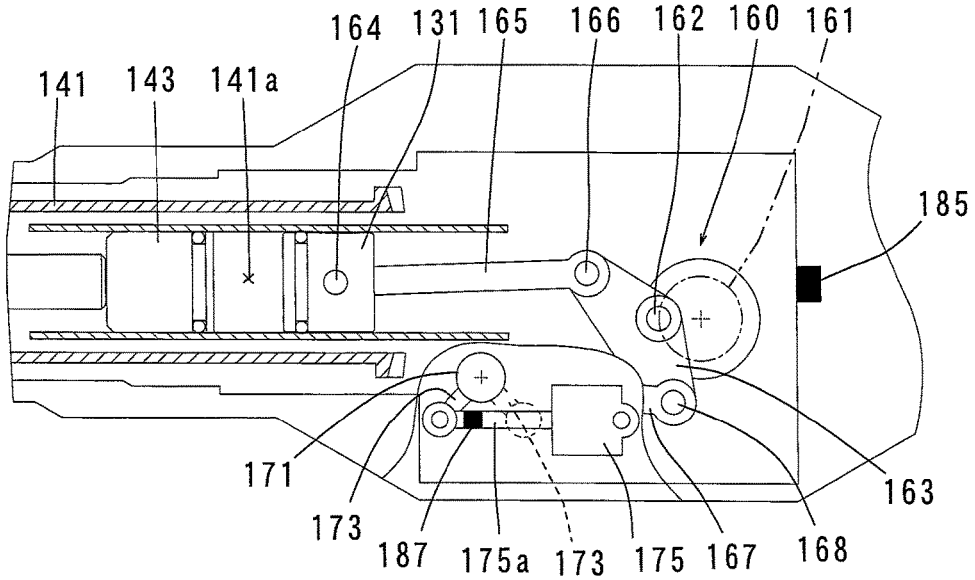
FIG. 12 shows an automatic switching apparatus as a position changing means for changing the stroke center position of the piston.

As shown in FIG. 12, an actuator 175 is provided for rotationally operating the control shaft 171. In FIG. 12, the electrical actuator 175 has a working element 175*a* which is moved linearly. The working element 175*a* is rotatably connected to an end part of an arm 173 which is connected to the crank shaft 171. Thus, when the working element 175*a* of the electrical actuator 175 is moved linearly in the front-rear direction, the control shaft 171 is rotated via the arm 173. Accordingly, the position of the eccentric shaft 172 of the control shaft 171 is changed. The control shaft 171 having the eccentric shaft 172 and the electrical actuator 175 are examples of a feature which corresponds to "a switching apparatus" of the present invention.

The electrical actuator 175 is controlled by the controller 113 illustrated in FIG. 1. The controller 113 controls the electrical actuator 175 based on the hardness of a workpiece. For this purpose, measuring means for measuring a parameter which indicates the hardness of a workpiece is provided in the hammer drill 100. The controller 113 evaluates the hardness of a workpiece based on a result of measurement which is inputted from the measuring means. If the hardness of a workpiece is hard, the controller 113 controls the electrical actuator 175 such that it moves the stroke center position of the piston 131 rearward. On the other hand, if the hardness of a workpiece is soft, the controller 113 controls the electrical actuator 175 such that it moves the stroke center of the piston 131 forward. The controller 113 is an example of a feature which corresponds to "a control apparatus" of the present invention. Further, the electrical actuator 175 is an example of a feature which corresponds to "a driving member" according to the present invention. Further, the control shaft 171 having the eccentric shaft 172 is an example of a feature which corresponds to "a movable member" of the present invention.

As shown in FIG. 1, a hammering reaction force sensor 181 which measures the hammering reaction force acting on the impact bolt 145 through the hammer bit 119, a position sensor 183 which measures a position of the hammer bit 119, a vibration sensor 185 which measures vibration caused on the main housing 101, and a load sensor 187 which measures load acting on the eccentric shaft 172 of the control lever 167 in the link type crank mechanism 160 and so on are utilized as the measuring means. Further, it is not illustrated for the convenience, a current sensor which measures current value of the electric motor 110 and a temperature sensor which measures temperature of the electric motor 110 may be utilized.

The hammering reaction force sensor 181 is an example of a feature which corresponds to "a first sensor" of the present invention, and the position sensor 183 is an example of a feature which corresponds to "a second sensor" of the present invention, and the vibration sensor 185 is an example of a feature which corresponds to "a third sensor" of the present invention, and the load sensor 187 is an example of a feature which corresponds to "a fifth sensor" of the present invention.

One of the sensors described above may be utilized independently. On the other hand, some of the sensors may be utilized together. Further, the electrical actuator 175 is controlled such that it adjusts rotational angel of the control shaft 171 in a continuously variable manner. That is, the stroke center position of the piston 131 is adjusted not only in two positions of its front position and rear position but also in any positions between the front point and the rear position. On the other hand, the stroke center position of the piston 131 may be switched in a multistage manner.

If the controller 113 detects based on the result of from the sensor that the hardness of a workpiece is hard, the controller 113 drives the electrical actuator 175 such that the eccentric shaft 172 of the control shaft 171 is moved forward. Thus, the swinging fulcrum of the control lever 167 is moved forward. Accordingly, the link 163 is rotated in a clockwise direction in FIG. 2 and FIG. 3 around the crank pin 162, and the piston 131 is moved rearward via the connection rod 165. That is, the stroke center position of the piston 131 is moved rearward. As a result, the distance between the piston 131 and the striker 143 is increased.

On the other hand, if the controller 113 detects based on the result from the sensor that the hardness of a workpiece is soft, the controller 113 drives the electrical actuator 175 such that the eccentric shaft 172 of the control shaft 171 is moved rearward. Thus, the swinging fulcrum of the control lever 167 is moved rearward. Accordingly, the link 163 is rotated in a counter-clockwise direction around the crank pin 162, and the piston 131 is moved forward via the connection rod 165. That is, the stroke center position of the piston 131 is moved forward. As a result, the distance between the piston 131 and the striker 143 is decreased.

As described above, according to the first embodiment, the stroke center position of the piston 131 is moved based on the hardness of a workpiece, and thereby the distance between the piston 131 and the striker 143 is adjusted according to the workpiece. Accordingly, variation in impact energy transmitted to the hammer bit 119 is suppressed. That is, the characteristic of the air spring of the air chamber 141*a* is controlled according to the hardness of a workpiece, and the hammer drill 100 is driven under an appropriate hammering performable status.

Further, in a state that the hammering reaction force is not occurred before the hammering operation, the piston 131 is controlled such that the stroke center position of the piston 131 is located at a forward position within a movable area. Accordingly, lack of rearward movement of the striker 143 by the air chamber 141*a* is prevented.

Further, according to the first embodiment, the controller 113 changes the stroke center position of the piston 131 according to the hardness of a workpiece. That is, the controller 113 automatically changes the position of the piston 131 based on the hardness of a workpiece.

Further, according to the first embodiment, the piston 131 is driven by the link type crank mechanism 160. Accordingly, as the stroke center position of the piston 131 is changed, a stroke length of the piston 131 is changed. As a straight line which passes a rotational center of the crank shaft 161 and is perpendicular to a piston moving direction is defined as a reference line, when an angle theta 1 between the reference line and a line connecting the link pin 166 and the connection pin 168 when the piston 131 is located in the bottom dead center substantially equals to an angle theta 2 between the reference line and the line connecting the link pin 166 and the connection pin 168 when the piston 131 is located in the top dead center, the stroke length of the piston 131 becomes the longest. On the other hand, when the angle theta 1 and the angle theta 2 are different to each other, the larger the angle difference is, the shorter the stroke length of the piston 131 becomes.

In the first embodiment, the angle difference between the angle theta 1 and theta 2 when the stroke center position of the piston 131 is moved rearward is defined to be smaller than the angle difference between the angle theta 1 and the theta 2 when the stroke center position of the piston 131 is moved forward. Therefore, when the stroke center position of the piston 131 is moved forward, the stroke length of the piston 131 becomes shorter, and when the stroke center position of the piston 131 is moved rearward, the stroke length of the piston 131 becomes longer. Accordingly, as the stroke length is changed due to the changing of the stroke center position of the piston 131, controllable region of the characteristic of the air spring is appropriately defined when the hammer drill 100 is manufactured.

In the first embodiment, the stroke center position of the piston 131 is changed according to the hardness of a workpiece, however it is not limited to this. For example, before and after a timing of the hammering operation is started in which the striker 143 is resting, the stroke center position of the piston 131 may be changed. Specifically, before the hammering operation is started, in order to move actively the resting striker 143, the stroke center position of the piston 131 may be moved to a front side which is close to the hammer bit 119. After the hammering operation is started, and when the striker 143 is driven in a predetermined stroke, the stroke center position of the piston 131 may be moved to a rear side which is remote from the hammer bit 119.

Figure 13:
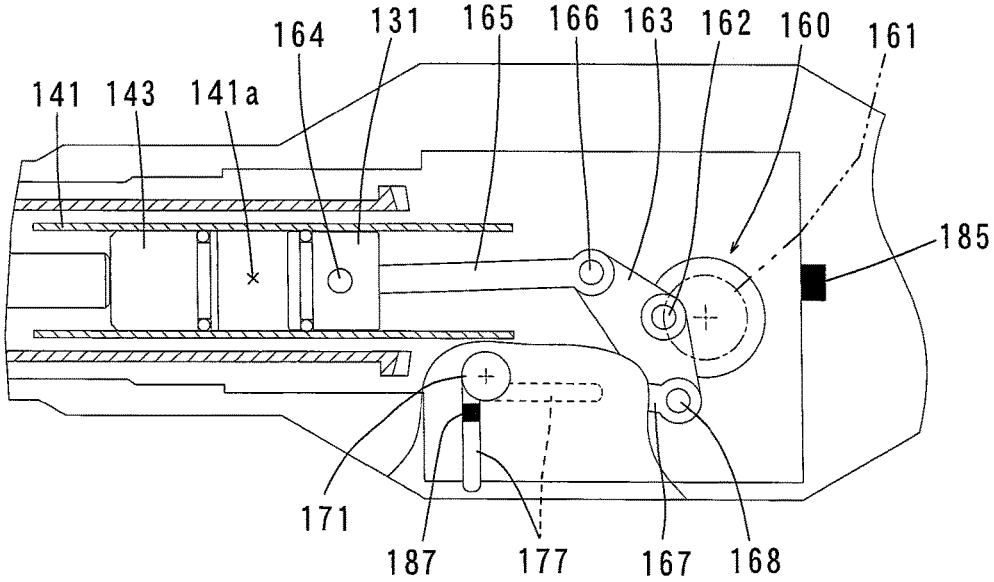
FIG. 13 shows a manual switching apparatus as a position changing means for changing the stroke center position of the piston.

Further, in the first embodiment, the stroke center position of the piston 131 is changed automatically, however it is not limited to this. For example, as shown in FIG. 13, the stroke center position of the piston 131 may be changed manually by a user. In a manually switch type construction in which a user switches the stroke center position of the piston 131, an operation lever 177 manually operated by a user for operating the control shaft 171 may be connected directly or indirectly via an intervening element to the control shaft 171. Further, the operation lever 177 may be provided to be rotationally operated outside the main housing 101. The operation lever 177 is an example of a feature which corresponds to "an operation member" according to the present invention.

In such a construction in which a user manually operates and switches the operation lever 177, before the hammering operation by the hammer drill 100, a user operates the operation lever 177 based on the hardness of a workpiece in such a manner illustrated by continuous lines and double-dashed lines in FIG. 13. Thus, the eccentric shaft 172 of the control shaft 171 as the swinging fulcrum of the control lever 167 is moved forward or rearward, and thereby the stroke center position of the piston 131 is changed. The control shaft 171 having the eccentric shaft 172, and the operation lever 177 are examples of a feature which corresponds to "a switch apparatus" according to the present invention. Further, the control shaft 171 having the eccentric shaft 172 is an example of a feature which corresponds to "a movable member" according to the present invention.

Second Embodiment

Next, a second embodiment is explained with reference to FIG. 14 and FIG. 15. In the second embodiment, by moving a driving mechanism which drives the piston 131, the stroke center position of the piston 131 is changed. That is, the driving mechanism for driving the piston 131 is mainly provided with the electric motor 110 (refer to FIG. 1), and a crank mechanism 133 driven by the electric motor 110. The crank mechanism 133 comprises a crank shaft 135 which is rotationally driven by the electric motor 110, and a crank pin 137 which is arranged on the crank shaft 135. The crank pin 137 and the piston 131 are connected by a connection rod 139. Further, the driving mechanism is provided such that it is movable in the longitudinal direction of the hammer bit 119 with respect to the main housing 101. The driving mechanism is configured to move forward and rearward in the longitudinal direction of the hammer bit 119 by an electrical actuator (not shown). In this embodiment, the driving apparatus includes crank mechanism 133 and electric motor 110.

Figure 14:
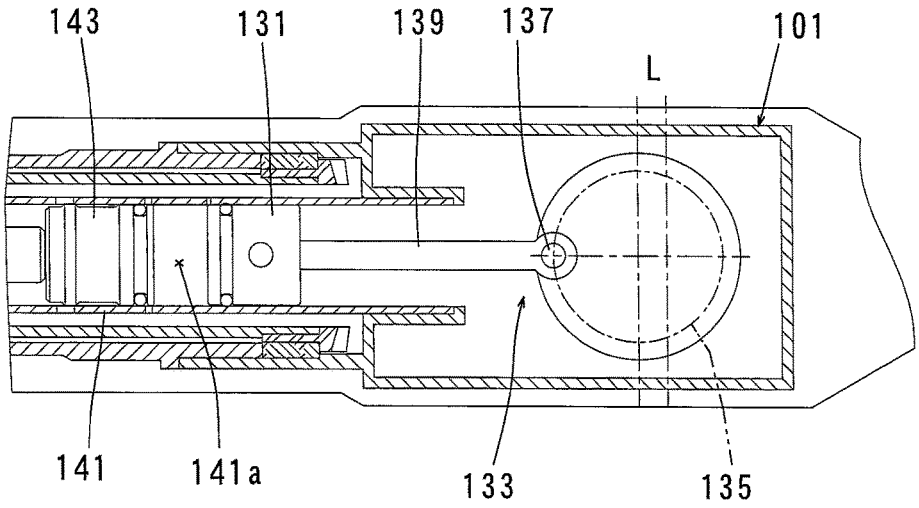
FIG. 14 shows a cross sectional view of a hammer drill according to a second embodiment in which a stroke center position of a piston is moved rearward.
Figure 15:
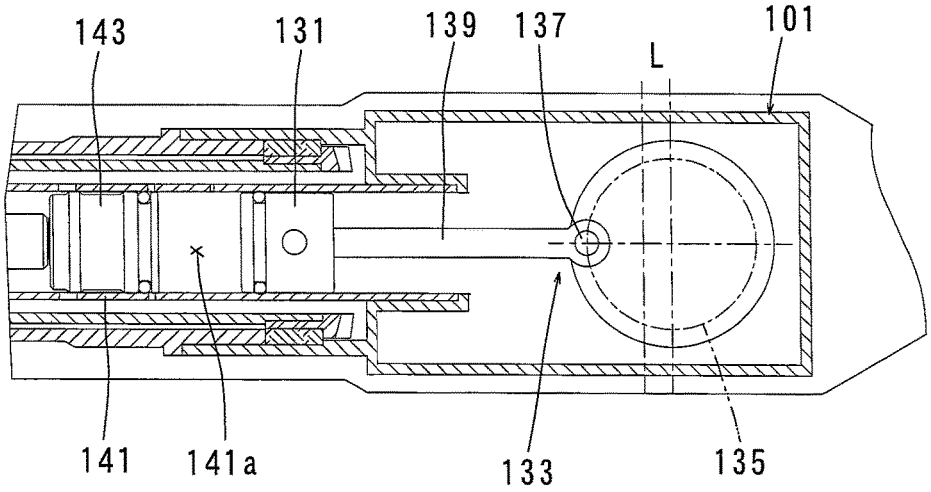
FIG. 15 shows a cross sectional view of the hammer drill according to the second embodiment in which the stroke center position of the piston is moved frontward.
Figure 16:
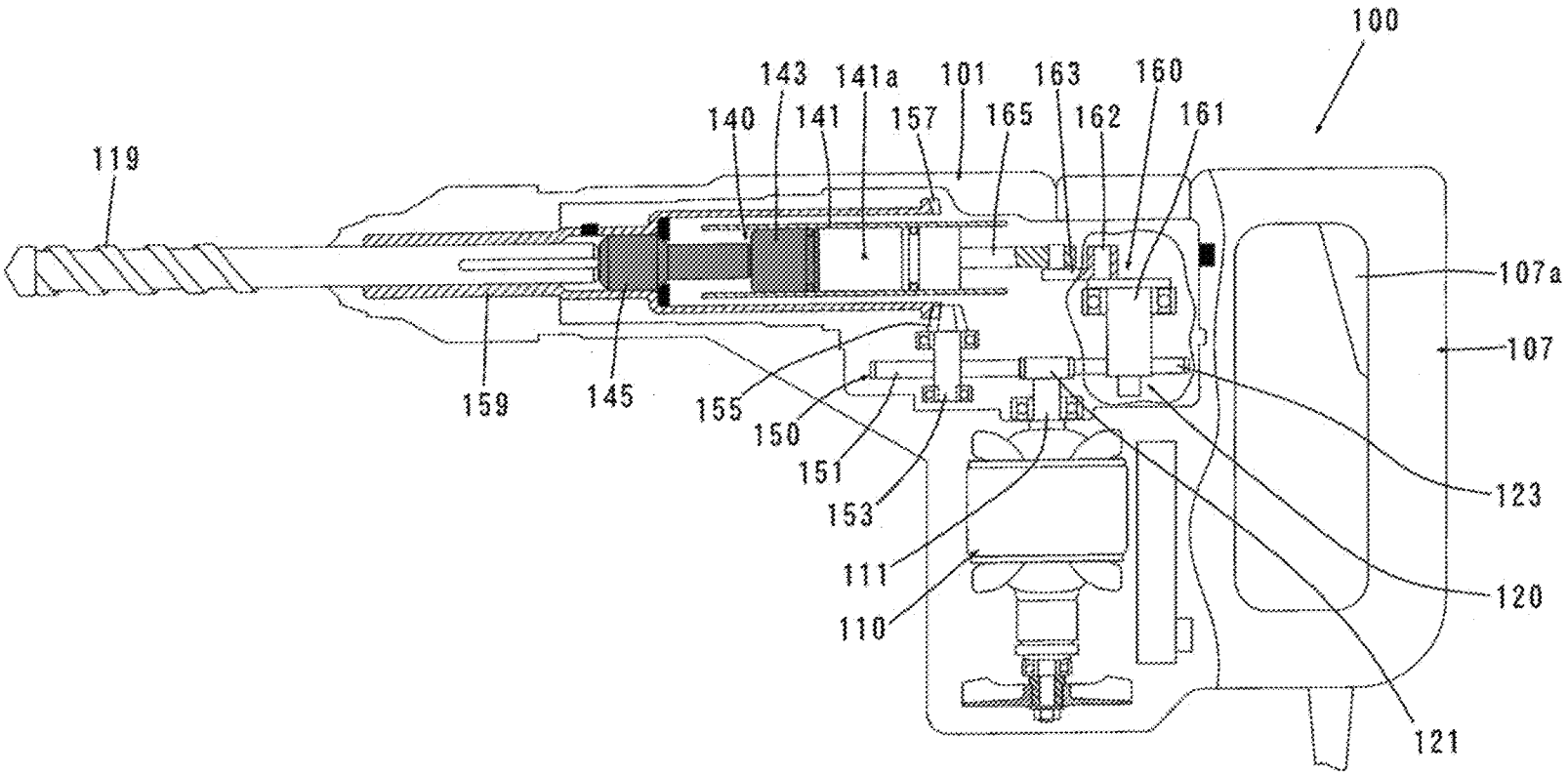
FIG. 16 shows a cross sectional view of whole construction of a hammer drill according to a third embodiment.

FIG. 14 illustrates the stroke center position of the piston 131 moved forward with respect to the main housing 101 by moving the driving mechanism forward. Further, FIG. 15 illustrates the stroke center position of the piston 131 moved rearward with respect to the main housing 101 by moving the driving mechanism rearward. Symbol L illustrated in FIG. 14 and FIG. 15 shows moving distance from the initial position of the crank shaft 135, respectively.

Further, a configuration in which the controller controls the electrical actuator and a configuration to measure the hardness of a workpiece are similar to the configuration of the first embodiment.

According to the second embodiment, similar to the first embodiment, the stroke center position of the piston 131 is changed according to the hardness of a workpiece. Therefore, the characteristic of the air spring of the air chamber 141*a* is controlled according to the hardness of a workpiece. As a result, the hammer drill 100 is driven under an appropriate hammering performable status.

Third Embodiment

Next, a third embodiment is explained with reference to FIG. 16 to FIG. 22. Further, components similar to that of the first embodiment are assigned by the same reference numerals and the explanation of the components is omitted.

The link pin 166 which connects the crank mechanism 160 and the connection rod 165 is an example of a feature which corresponds to "a first support part" according to the present invention. Further, the control lever 167 is an example of a feature which corresponds to "a control member" according to the present invention. Further, the connection pin 168 which connects the control lever 167 and the link 163 is an example of a feature which corresponds to "a second support part" according to the present invention.

Figure 18:
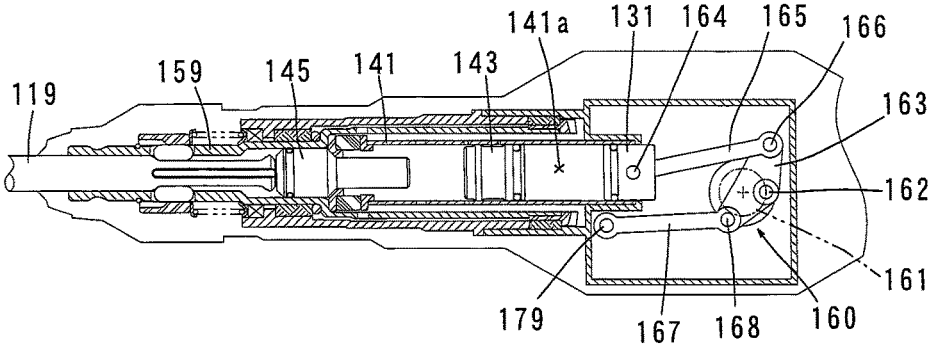
FIG. 18 shows a cross sectional view of operating link type crank mechanism and shows a bottom dead center (0 degree crank angle position) in which a piston is moved to the most rear position.
Figure 19:
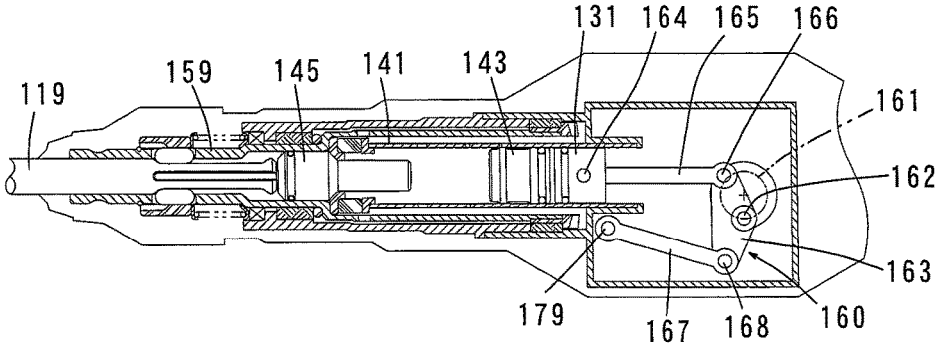
FIG. 19 shows a cross sectional view in which the piston is moved (to substantially 90 degrees crank angle position) from the bottom dead center shown in FIG. 18 toward a top dead center and shows air chamber maximally compressed state.
Figure 20:
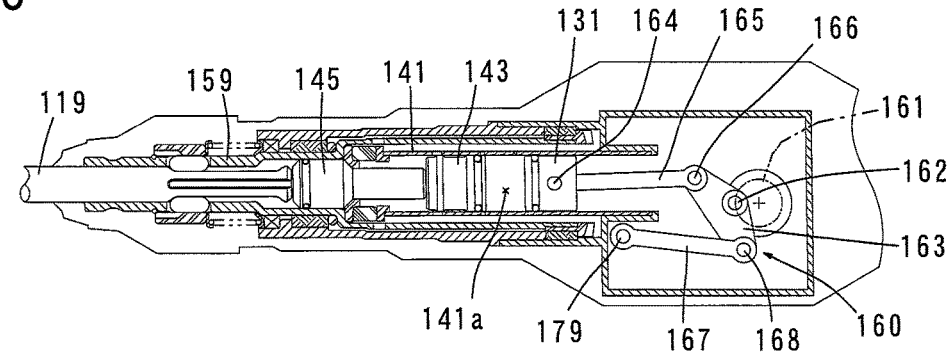
FIG. 20 shows a cross sectional view of the top dead center (180 degrees crank angle position) in which the piston is moved to the most front position.
Figure 21:
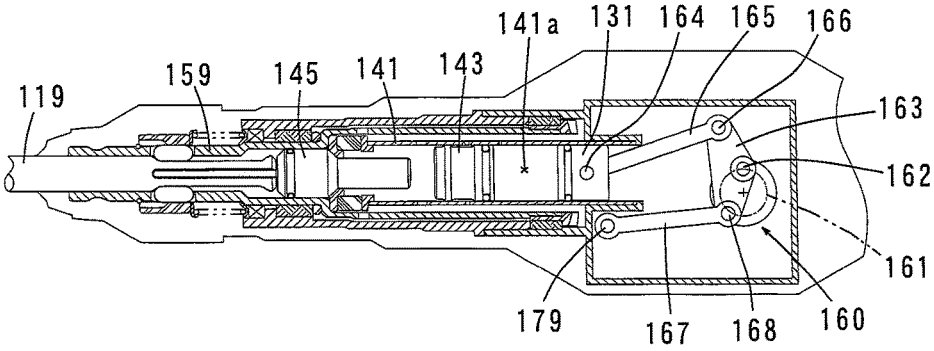
FIG. 21 shows a cross sectional view in which the piston is moved (to substantially 270 degrees crank angle position) from the top dead center toward the bottom dead center.

FIG. 18 to FIG. 21 illustrate movement of the piston 131. FIG. 18 illustrates the piston 131 to be moved to the most rear position (bottom dead center) and 0 degree (360 degrees) in crank angle regarding the position of the crank pin 162. FIG. 20 illustrates the piston 131 to be moved to the most front position (top dead center) and 180 degrees in crank angle regarding the position of the crank pin 162.

The piston 131 reciprocally moves between the top dead center and the bottom dead center. Further, the piston 131 moves forward from the bottom dead center to the top dead center through the position illustrated in FIG. 19. Further, after the hammering operation, the piston 131 moves rearward from the top dead center to the bottom dead center through the position illustrated in FIG. 21.

Figure 17:
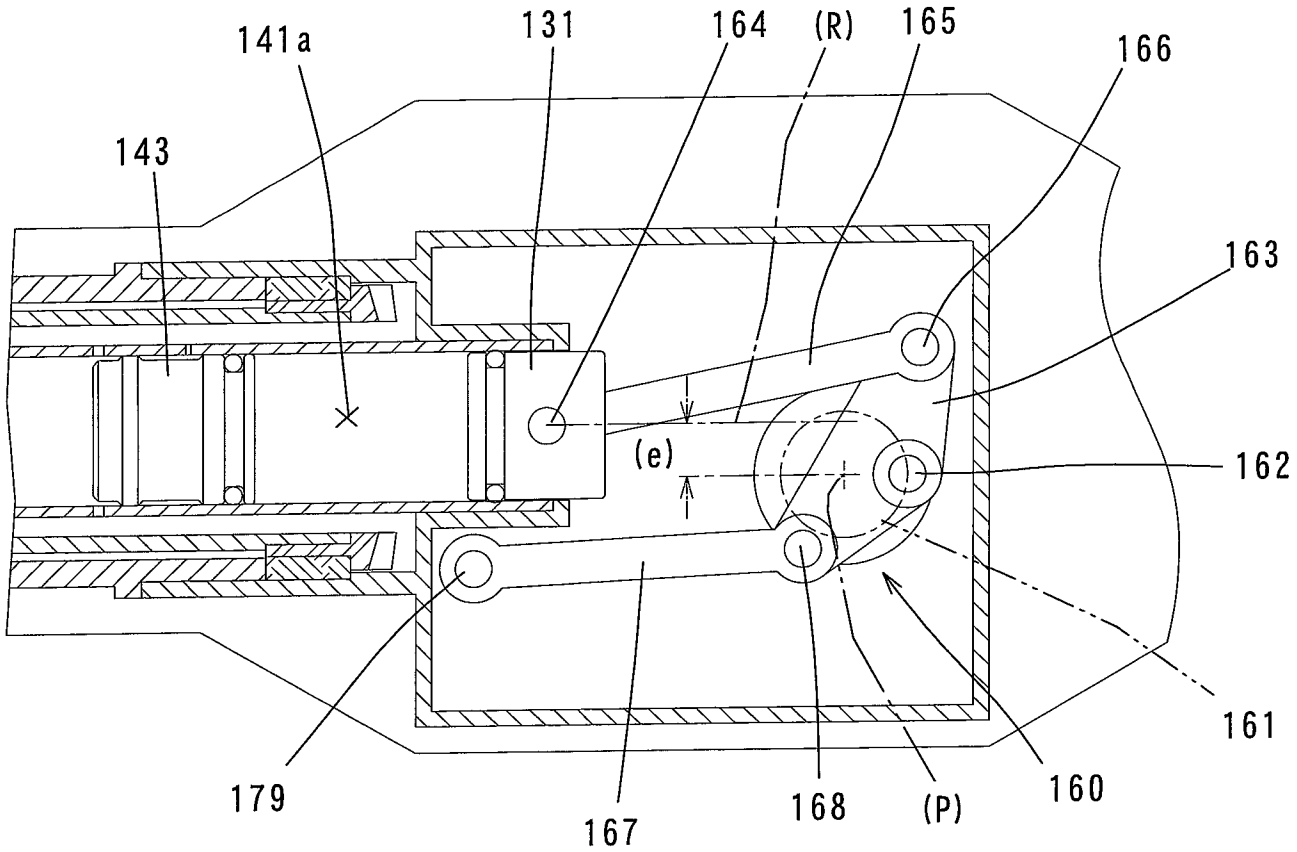
FIG. 17 shows a cross sectional view of a link type crank mechanism.

In the third embodiment, as shown in FIG. 17, a rotation center (P) of the crank shaft 161 in the crank mechanism 160 is located to be offset from a moving line (R) of the piston 131 in a direction crossing the moving line (R). That is, the rotation center (P) is located between the moving line (R) and the connection pin 168 in the direction crossing the moving line (R). Accordingly, when the piston 131 is positioned at a position which corresponds to maximally compressed status (approximately 90 degrees in the crank angle of the crank pin 162), the connection rod 165 becomes substantially parallel to the axial line of the cylinder 141. That is, an offset amount (e) of the rotation center (P) of the crank shaft 161 with respect to the moving line (R) of the piston 131 is defined such that the connection rod 165 becomes substantially parallel to the axial line of the cylinder 141 when the piston 131 moving from the bottom dead center to the top dead center is moved to the position of approximately 90 degrees in the crank angle. In such a case, approximately 90 degrees means a range from 70 degrees to 110 degrees.

Accordingly, when the piston 131 moving from the bottom dead center to the top dead center is moved to the position of approximately 90 degrees in the crank angle, the air chamber 141*a* becomes the maximally compressed status. At this time, the connection rod 165 and the moving line (R) of the piston 131 is to be parallel to each other. Therefore, a force direction applied to the piston 131 by the connection rod 165 is matched with the moving direction of the piston 131. That is, the piston 131 is prevented from being biased by force in the direction crossing the moving direction of the piston 131. Thus, the piston 131 is prevented from being pressed against the inner wall of the cylinder 141. As a result, friction loss between the piston 131 and the cylinder 141 is reduced and thereby the piston 131 is efficiently driven.

Figure 22:
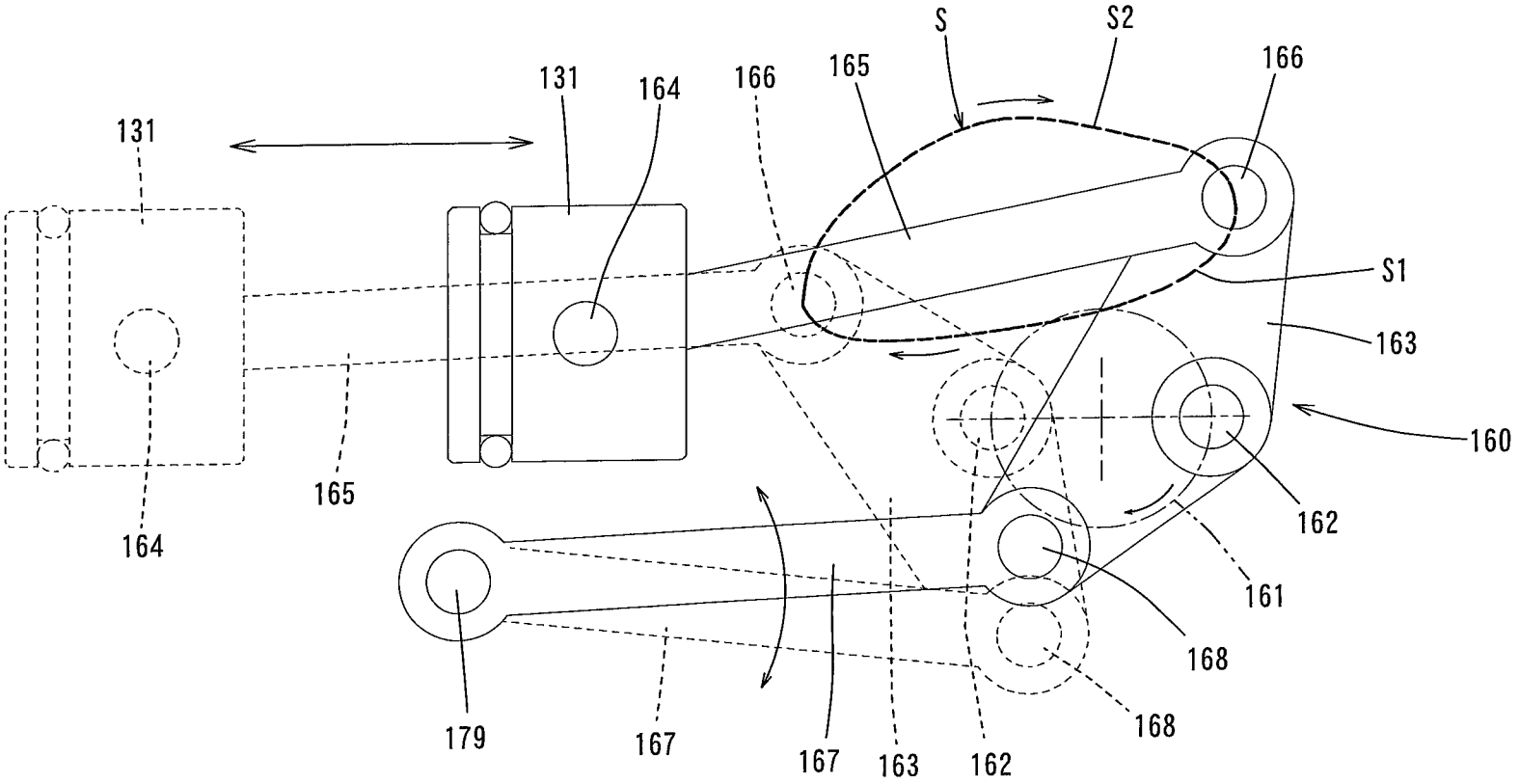
FIG. 22 shows a view for explaining a relationship between a moving amount of the piston and a moving amount of the link.

Further, according to the third embodiment, in the crank mechanism 160, the link 163 is swingably and interveningly provided between the crank pin 162 and the connection rod 165. Thus, as the crankpin 162 is rotated, the link 163 is swung around the connection pin 168 as a fulcrum, which connects the link 163 and the control lever 167. Accordingly, as shown in FIG. 22, the link pin 166 which connects the link 163 and the connection rod 165 performs an orbital motion along substantially ellipse track S. A longitudinal direction of the ellipse track of the orbital motion is substantially along the moving direction of the piston 131. That is, when the crank pin 162 is moved from the position of 0 degree crank angle (bottom dead center) to the position of 180 degrees crank angle (top dead center), the link pin 166 performs a first orbital motion along the lower half part of the ellipse track. On the other hand, when the crank pin 162 is moved from the position of 180 degrees crank angle to the position of 0 degree (360 degrees) crank angle, the link pin 166 performs a second orbital motion along the upper half part of the ellipse track.

A distance between the link pin 166 and the connection pin 168 is longer than a distance between the crank pin 162 and the connection pin 168. That is, the link pin 166 is located further away from the connection pin 168 than the crankpin 162. Therefore, a moving amount of the rink pin 166 in a direction parallel to the moving line (R) is larger than a moving amount of the crank pin 162 in the direction parallel to the moving line (R). That is, moving amount of the crankpin 162 is amplified and transmitted to the piston 131 in the moving direction of the piston 131. In other words, the moving amount is increased by the principle of leverage. Therefore, a moving amount of the crank pin 166 in a direction crossing the moving line (R) is smaller than a moving amount of the piston 131. Accordingly, a swing angle of the connection rod 165 becomes to be smaller. As a result, interference between the connection rod 165 and the cylinder 141 is avoided. Further, axial length of the connection rod 165 is able to be shorter. Further, as the crank shaft 161 is able to be provided proximal to the cylinder 141, to downsize the hammer drill 100 is achievable.

Further, according to the third embodiment, as the crank pin 162 is arranged between the link pin 166 and the connection pin 168, each components of the crank mechanism 160 is rationally arranged.

Fourth Embodiment

Next, a fourth embodiment is explained with reference to FIG. 23. In the fourth embodiment, a driving mechanism for driving the piston 131 is mainly provided with the electric motor 110 and the crank mechanism 133. That is, the crank mechanism 133 comprises the crank shaft 135 driven by the electric motor 110 (refer to FIG. 16), and the crank pin 137 which is arranged on the crank shaft 135. The crank pin 137 and the piston 131 are connected by a connection rod 139. The crank mechanism 133 is an example of a feature which corresponds to "a crank mechanism" according to the present invention. Further, the crank shaft 135 and the crank pin 137 are examples of features which correspond to "a crank shaft" and "an eccentric shaft" according to the present invention, respectively.

Figure 23:
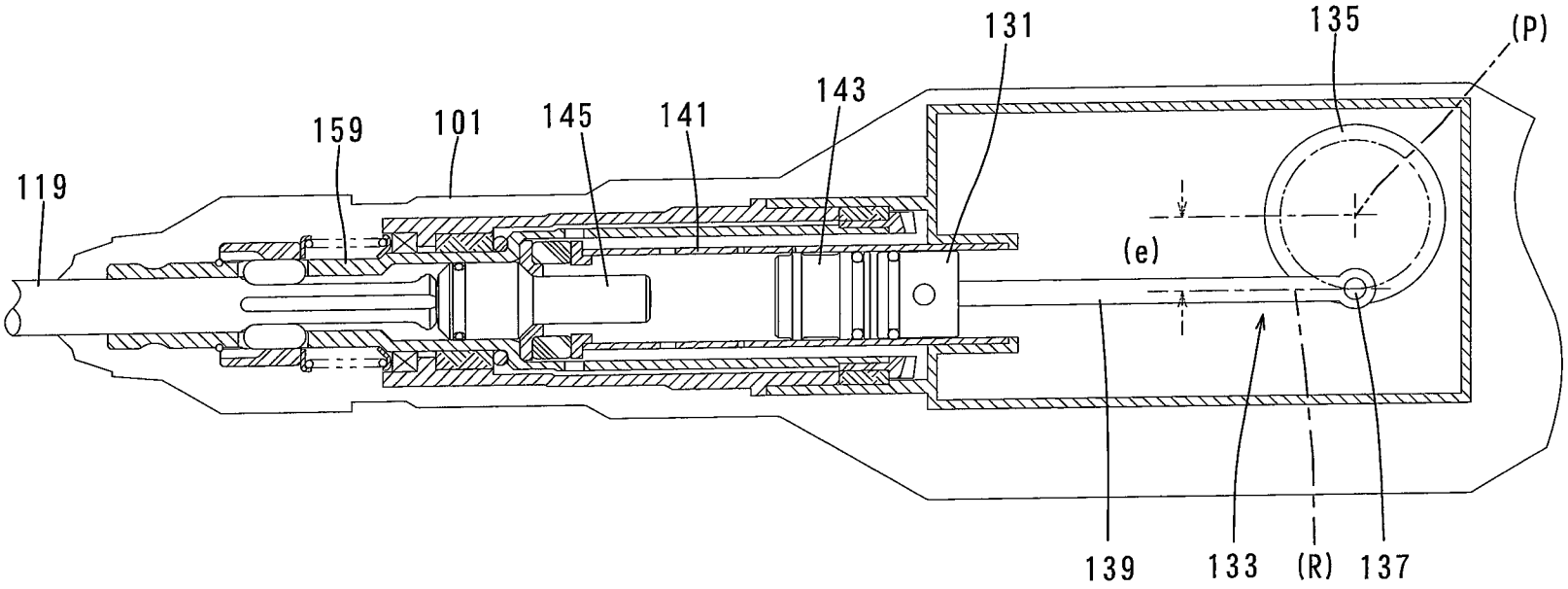
FIG. 23 shows a cross sectional view of a hammer drill according to a fourth embodiment.

As shown in FIG. 23, the rotation center (P) of the crank shaft 135 is located to be offset from a moving line (R) of the piston in a direction crossing the moving line (R). Accordingly, when the piston 131 is positioned at a position which corresponds to maximally compressed status (approximately 90 degrees in the crank angle of the crank pin 137), the connection rod 139 becomes substantially parallel to the axial line of the cylinder 141. That is, an offset amount (e) of the rotation center (P) of the crank shaft 135 with respect to the moving line (R) of the piston 131 is defined such that the connection rod 139 becomes substantially parallel to the axial line of the cylinder 141 when the piston 131 moving from the bottom dead center to the top dead center is moved to the position of approximately 90 degrees in the crank angle. In such a case, approximately 90 degrees means a range from 70 degrees to 110 degrees.

According to the fourth embodiment, similar to the third embodiment, when the piston 131 moving from the bottom dead center to the top dead center is moved to the position of approximately 90 degrees in the crank angle, the air chamber 141*a* becomes the maximally compressed status. At this time, the connection rod 139 and the moving line (R) of the piston 131 is to be parallel to each other. Therefore, a force direction applied to the piston 131 by the connection rod 139 is matched with the moving direction of the piston 131. That is, the piston 131 is prevented from being biased by force in the direction crossing the moving direction of the piston 131. Thus, the piston 131 is prevented from being pressed against the inner wall of the cylinder 141. As a result, friction loss between the piston 131 and the cylinder 141 is reduced and thereby the piston 131 is efficiently driven.

Further, in the embodiments described above, the hammer drill 100 as one example of the hammer tool is utilized to explain, however it is not limited to this. For example, the present invention may be applied to a hammer in which the hammer bit 119 performs only hammer operation. Further in the hammer tool, the piston 131 may hit directly the striker 143.

Taking into consideration the above objects of the present invention, the following aspects of the hammer tool according to the present invention are configurable.

(Aspect 1)

An hammer tool which at least linearly drives a tool bit at least linearly in a longitudinal direction of the tool bit and performs a hammering operation on a workpiece, comprising:

a main body, a cylinder which is arranged in the main body, a hammering element which is slidably arranged in the cylinder, a piston which is slid in the cylinder and drives the hammering element, a connection rod which is connected to the piston, and a crank mechanism which is connected to the connection rod and drives the piston, wherein the hammer tool is configured to perform a hammering operation on a workpiece by hitting the tool bit by the hammering element, and while the piston is moved from a bottom dead center which is most remote from the tool bit to a top dead center which is the closest to the tool bit, a straight line joining a connecting part which connects the connection rod and the piston and a connecting part which connects the connection rod and the crank mechanism is arranged to be parallel to the cylinder.

(Aspect 2)

The hammer tool according to Aspect 1, as an angle corresponding to the bottom dead center is defined as 0 degree and an angle corresponding to the top dead center is defined as 180 degrees with respect to a crank angle of the crank mechanism, while the piston is moved from the bottom dead center to the top dead center, when the crank mechanism is substantially 90 degrees of the crank angle position, the connection rod is configured to be parallel to the cylinder.

(Aspect 3)

The hammer tool according to Aspect 1 or 2, when the connection rod is parallel to the cylinder, the hammering element is configured to start toward the tool bit.

(Aspect 4)

The hammer tool according to any one of Aspects 1 to 3, wherein a rotation center of the crank mechanism is arranged offset from a reciprocating moving line of the piston which is moved in the cylinder with respect to a direction crossing the reciprocating moving line.

(Aspect 5)

The hammer tool according to according to anyone of Aspects 1 to 4, wherein the crank mechanism comprises a rotatable crank shaft and an eccentric shaft which is connected to the crank shaft at a position eccentric from a rotation axis of the crank shaft, the hammer tool further comprises a swing member which is arranged between the eccentric shaft and the connection rod and swingably connected to both of the eccentric shaft and the connection rod respectively, and a control member one end side of which is swingably supported on the main body and the other end side of which is swingably connected to the swing member.

(Aspect 6)

The hammer tool according to Aspect 5, wherein a moving amount of the piston is configured to be larger than a moving amount of the eccentric shaft in a moving direction of the piston.

(Aspect 7)

The hammer tool according to Aspect 5 or 6, comprising a first support part which connects the swing member and the connection rod in a swingable manner to each other, and a second support part which connects the swing member and the control member in a swingable manner to each other, wherein the eccentric shaft is arranged between the first support part and the second support part in an joining direction of the first support part and the second support part.

(Aspect 8)

The hammer tool according to claim 11, wherein the switch apparatus comprises an operation member which is operable by a user, and a support member which is provided as a movable member of which position is changed due to movement of the operation member, the stroke center position is configured to be changed by changing position of the support member.

(Aspect 9)

The hammer tool according to claim 11, wherein the switch apparatus comprises an operation member which is operable by a user, and a movable member of which position is changed due to movement of the operation member, the stroke center position is configured to be changed by changing position of the movable member.

(Correspondence Relationships Between the Constituent Elements of the Present Embodiments and the Constituent Elements of the Present Invention)

The correspondence relationships between the constituent elements of the present embodiments and the constituent elements of the present invention are as follows. Furthermore, the present embodiments describe one example of a mode for carrying out the present invention, but the present invention is not limited to the configuration of the present embodiments.

The main housing 101 is one example of a structural element which corresponds to "a main body" of the present invention.

The hammer bit 119 is one example of a structural element which corresponds to "a tool bit" of the present invention.

The electric motor 110 is one example of a structural element which corresponds to "a motor" of the present invention.

The piston 131 is one example of a structural element which corresponds to "a driving element" of the present invention.

The striker 143 is one component or portion of "a hammering element" of the present invention.

The bottom dead center is one example of a structural element which corresponds to "a first position" of the present invention.

The top dead center is one example of a structural element which corresponds to "a second position" of the present invention.

The crank mechanism 133 is one example of a structural element which corresponds to "a crank mechanism" of the present invention.

The crank shaft 161 is one example of a structural element which corresponds to "a crank shaft" of the present invention.

The crank pin 162 is one example of a structural element which corresponds to "an eccentric shaft" of the present invention.

The link 163 is one example of a structural element which corresponds to "a swing member" of the present invention.

The connection rod 165 is one example of a structural element which corresponds to "a connection member" of the present invention.

The control lever 167 is one example of a structural element which corresponds to "a control member" of the present invention.

The eccentric shaft 172 is one example of a structural element which corresponds to "a switch apparatus" of the present invention.

The electrical actuator 175 is one example of a structural element which corresponds to "a switch apparatus" of the present invention.

The eccentric shaft 172 is one example of a structural element which corresponds to "a support part" of the present invention.

The controller 113 is one example of a structural element which corresponds to "a control apparatus" of the present invention.

The hammering reaction force sensor 181 is one example of a structural element which corresponds to "a first sensor" of the present invention.

The position sensor 183 is one example of a structural element which corresponds to "a second sensor" of the present invention.

The vibration sensor 185 is one example of a structural element which corresponds to "a third sensor" of the present invention.

The load sensor 187 is one example of a structural element which corresponds to "a fifth sensor" of the present invention.

The current sensor is one example of a structural element which corresponds to "a fourth sensor" of the present invention.

DESCRIPTION OF NUMERALS

100 hammer drill
101 main housing
107 hand grip
**107*a*** trigger
110 electric motor
111 output shaft
113 controller
119 hammer bit
120 motion converting mechanism
121 driving gear
123 driven gear
131 piston
133 crank mechanism
135 crank shaft
137 crank pin
139 connection rod
140 hammering element
141 cylinder
**141*a*** air chamber
143 striker
145 impact bolt
150 motion transmitting mechanism
151 intermediate gear
153 intermediate shaft
155 small bevel gear
157 large bevel gear
159 tool holder
160 crank mechanism
161 crank shaft
162 crank pin
163 link
164 piston pin
165 connection rod
166 link pin
167 control lever
168 connection pin
171 control shaft

172 eccentric shaft
173 arm
175 electrical actuator
175*a* working element
177 operation lever
181 hammering reaction force sensor
183 position sensor
185 vibration sensor
187 load sensor

The invention claimed is:

1. A hammer tool which at least linearly drives a tool bit at least linearly in a longitudinal direction of the tool bit and performs a hammering operation on a workpiece, comprising:

a main body, a cylinder which is arranged in the main body and extended in the longitudinal direction of the tool bit, a hammering element which drives linearly in the longitudinal direction of the tool bit in the cylinder and hits the tool bit, a driving element which is slidably arranged in the cylinder and is configured to move the hammering element, and a driving apparatus which drives the driving element, wherein the driving element is arranged inside the cylinder such that it reciprocally moves in the cylinder along the longitudinal axis of the cylinder between a first position at which the driving element is most remote from the tool bit and a second position at which the driving element is closest to the tool bit, when the driving element is moved from the first position to the second position, the driving element moves the hammering element toward the tool bit and the hammering element hits the tool bit, and wherein the reciprocal movement of the driving element has a stroke center position relative to the cylinder between the first position and the second position; and wherein the driving element and driving apparatus are configured to change the stroke center position.

2. The hammer tool according to claim 1, comprising a switch apparatus for changing the stroke center position.

3. The hammer tool according to claim 2, wherein the switch apparatus is configured to be manually operable by a user.

4. The hammer tool according to claim 3, wherein the switch apparatus comprises an operation member which is operable by a user and a movable member which is switched its position due to a movement of the operation member, and the stroke center position is changed by switching the position of the movable member.

5. The hammer tool according to claim 2, comprising a control apparatus which controls the switch apparatus, wherein the control apparatus is configured to change the stroke center position by controlling the switch apparatus.

6. The hammer tool according to claim 5, wherein the switch apparatus comprises a driving member which is driven by the control apparatus and a movable member which is switched its position due to a driving of the driving member, and the stroke center position is changed by switching the position of the movable member.

7. The hammer tool according to claim 5, comprising a first sensor which measures reaction force caused by the hammering operation of the tool bit, wherein the control apparatus is configured to control the switch apparatus based on a measured result of the first sensor and change the stroke center position.

8. The hammer tool according to claim 5, comprising a second sensor which measures position of the tool bit, wherein the control apparatus is configured to control the switch apparatus based on a measured result of the second sensor and change the stroke center position.

9. The hammer tool according to claim 5, comprising a third sensor which measures vibration caused on the main body, wherein the control apparatus is configured to control the switch apparatus based on a measured result of the third sensor and change the stroke center position.

10. The hammer tool according to claim 5, comprising a fourth sensor which measures the current to the motor, wherein the control apparatus is configured to control the switch apparatus based on a measured result of the fourth sensor and change the stroke center position.

11. The hammer tool according to claim 1, wherein the driving apparatus comprises a motor and a crank mechanism which is driven by the motor, the crank mechanism comprises a crank shaft having an eccentric shaft, the crank shaft rotationally driven by the motor, and a swing member which is connected to the eccentric shaft swingably around the eccentric shaft, the hammer tool further comprises a connecting member which connects the swing member and the driving element, one end side of the connecting member is swingably connected to the swing member and the other end side is swingably connected to the driving element, and a control member one end side of which is swingably connected to the swing member and the other end side of which is swingably connected to a support part arranged on the main body, and the stroke center position is changed by changing a position of the support part.

12. The hammer tool according to claim 11, comprising a switch apparatus for changing the stroke center position, a control apparatus which controls the switch apparatus, and a fifth sensor which measures load applied on the support part, wherein the control apparatus is configured to control the switch apparatus based on a measurement result of the fifth sensor and change the stroke center position.

13. The hammer tool according to claim 11, wherein a stroke length of a driving element is changed when the stroke center position is changed.

14. The hammer tool according to claim 1, comprising a connection rod which is connected to the driving element, and a crank mechanism which is connected to the connection rod, the crank mechanism configured to drive the driving element, wherein while the driving element is moved from a bottom dead center which is the most remote from the tool bit to a top dead center which is the closest to the tool bit, a straight line between a connecting part of the connection rod and the driving element and a connecting part of the connection rod and the crank mechanism is arranged to be parallel to the cylinder.

15. The hammer tool according to claim 14, with respect to a crank angle of the crank mechanism, an angle corresponding to the bottom dead center is defined as 0 degree, and an angle corresponding to the top dead center is defined as 180 degrees, and when the crank mechanism moving from the bottom dead center to the top dead center of the piston is positioned at substantially 90 degrees crank angle position, the connection rod is to be parallel to the cylinder.

16. The hammer tool according to claim 14, when the connection rod is parallel to the cylinder, the hammering element is configured to start to move toward the tool bit.

17. The hammer tool according to claim 14, wherein a rotation center of the crank mechanism is arranged to be offset from a reciprocating moving line of the driving element moved inside the cylinder with respect to a direction crossing the reciprocating moving line.

18. The hammer tool according to claim 14, wherein the crank mechanism comprises a rotatable crank shaft and an eccentric shaft connected to the crank shaft at a position eccentric from a rotational axis of the crank shaft, the hammer tool further comprises a swing member which is interveningly arranged between the eccentric shaft and the connection rod and swingably connected to both of the eccentric shaft and the connection rod respectively, and a control member one end side of which is swingably supported on the main body and the other end side of which is swingably connected to the swing member.

19. The hammer tool according to claim 18, wherein the distance the piston moves is larger than the distance the eccentric shaft moves in the direction of movement of the driving element.

20. The hammer tool according to claim 18, comprising a first support part which connects the swing member and the connection rod in a swingable manner to each other, and a second support part which connects the swing member and the control member in a swingable manner to each other, wherein the eccentric shaft is arranged between the first support part and the second support part in an extending direction of a line between the first support part and the second support part.

21. A hammer tool in which a tool bit drives at least linearly in a longitudinal direction of the tool bit and performs a hammering operation on a workpiece, comprising:

a main body, a cylinder which (1) is arranged inside the main body and (2) has a center axis, a hammering element which is slidably arranged within the cylinder, a driving element which is slid inside the cylinder and drives the hammering element, a connection rod which is connected to the driving element, a crank mechanism which is connected to the connection rod and drives a piston as the driving element, wherein:

the driving element has a bottom dead center position in which the driving element is most remote from the tool bit and a top dead center position in which the driving element is closest to the tool bit, the connection rod has a longitudinal axis, and the cylinder, the driving element and the connection rod are configured such that, at some point when the driving element is between the top dead center position and the bottom dead center position, but not at the top dead center position or the bottom dead center position, the longitudinal axis of the connection rod is parallel to the center axis of the cylinder.

* * * * *